US005773798A

United States Patent [19]

Fukumura

[11] Patent Number: 5,773,798

[45] Date of Patent: Jun. 30, 1998

[54] METHOD OF HEATING FLUID WITH MAGNETS

[76] Inventor: Mamoru Fukumura, 275, Kubo 6-chome, Kanazawa-shi, Ishikawa 921, Japan

[21] Appl. No.: 839,247

[22] Filed: Apr. 15, 1997

[30] Foreign Application Priority Data

Apr. 17, 1996 [JP] Japan ..... 8-120885

[51] Int. Cl.[6] ..... H05B 6/10

[52] U.S. Cl. ..... 219/631; 219/672

[58] Field of Search ..... 219/631, 628, 219/629, 630, 672

[56] References Cited

U.S. PATENT DOCUMENTS

| | | | |
|---|---|---|---|
| 4,217,475 | 8/1980 | Hagerty | 219/631 |
| 4,238,337 | 12/1980 | Peters et al. | 219/628 |
| 4,511,777 | 4/1985 | Gerard | 219/631 |
| 4,600,821 | 7/1986 | Fichtner et al. | 219/631 |
| 4,614,853 | 9/1986 | Gerard et al. | 219/631 |
| 4,678,881 | 7/1987 | Griffith | 219/631 |

*Primary Examiner*—Philip H. Leung
*Attorney, Agent, or Firm*—King & Schickli

[57] ABSTRACT

A method for heating a fluid in a pipe by transforming induced current flowing through a conductor directly to heat energy as the conductor moves through a magnetic field. The method comprises locating N and S poles of a magnet adjacent the outer peripheral surface of a pipe on opposite sides, respectively thereof. A conductor in the form of heating wires is secured to a central shaft in the interior of the pipe. The heating wires have portions orthogonally intersecting with a magnetic line of force defined between the N and S poles and constitute a closed circuit. An impeller secured to the central shaft is caused to be rotated by the flow of the fluid flowing through the pipe, which in turn causes simultaneous rotation of the heating lines fixed to the central shaft. As a result the heating lines are heated due to induced current generated therein. This, in turn, heats the fluid.

1 Claim, 1 Drawing Sheet

METHOD OF HEATING FLUID WITH MAGNETS

FIELD OF THE INVENTION

The present invention relates to a method for heating a fluid such as liquid or gas flowing through the interior of a pipe to raise the temperature of the fluid.

BACKGROUND OF THE INVENTION

In order to heat a fluid flowing through the interior of a pipe, it has been a common practice to heat the pipe itself by means of a heat source.

It is known that moving a conductor within a magnetic field in a direction perpendicular to the magnetic line of force will generate an electromotive force and cause induced current to flow through the conductor if the latter defines a closed circuit. However, the prior art has not utilized such induced current, but relied on heating the pipe itself by means of a heat source, so that it has required an elaborate heating apparatus involving a large heat source.

SUMMARY OF THE INVENTION

Accordingly, it is an object of this invention to provide an improved method of heating a fluid flowing through the interior of a pipe by transforming induced current flowing through a conductor directly to heat energy as the conductor moves through a magnetic field.

In order to accomplish the foregoing object, this invention provides a method for heating a fluid flowing through an interior of a pipe having a wall with an inner and outer peripheral surface, said method comprising the steps of locating N and S poles of a magnet adjacent the outer peripheral surface of said pipe on opposite sides, respectively thereof; disposing heating line means as a conductor in the interior of the pipe between the N and S poles of the magnet, the heating line means having portions orthogonally intersecting with a magnetic line of force defined between the N and S poles; and rotating those portions of the heating line means orthogonally intersecting with the magnetic line of force around the inner peripheral surface of the pipe in a direction perpendicular to the magnetic line of force to heat the fluid flowing through the interior of the pipe.

It is thus to be appreciated that the present invention provides for rotating a conductor in the interior of the pipe between the N and S poles of the magnet in a direction perpendicular to the magnetic line of force to thereby allow induced current to flow through the conductor constituting a closed circuit.

Because a heating element is used as the conductor, it transforms the induced current flowing therethrough to heat energy, which is in direct heat transfer relation with the fluid in the pipe to raise the temperature of the fluid.

BRIEF DESCRIPTION OF THE DRAWINGS

The foregoing summary, as well as the following detailed description, will be better understood when read in conjunction with the accompanying drawings, in which.

DESCRIPTION OF THE PREFERRED EMBODIMENT OF THE INVENTION

An embodiment of the present invention will be described with reference to the accompanying drawings.

Figure 1:
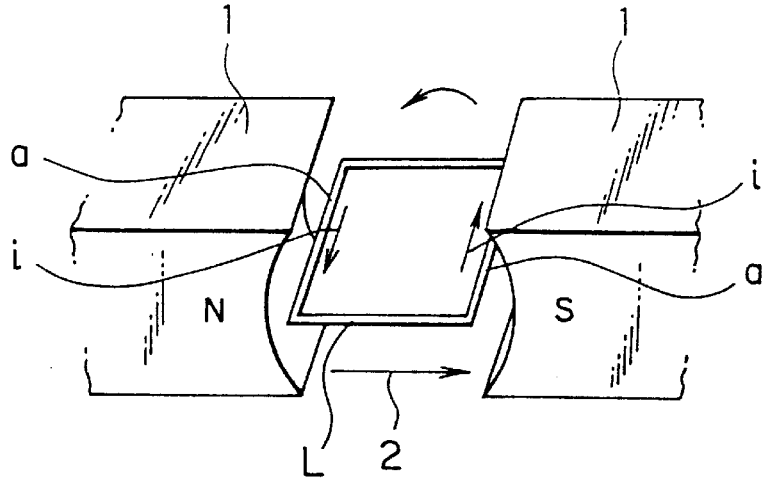
FIG. 1 is a schematic illustration showing the principle on which the method of the present invention operates.
Figure 2:
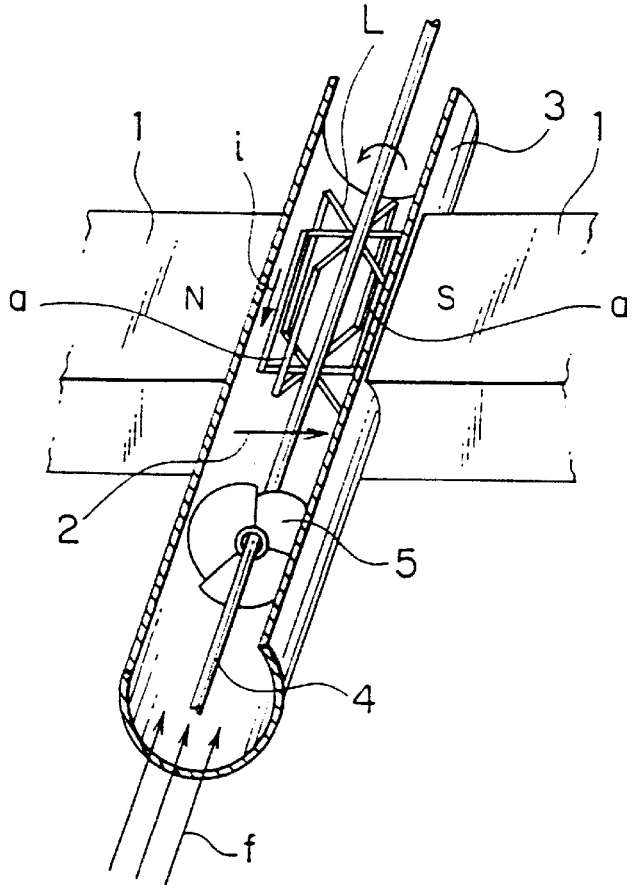
FIG. 2 is a perspective, partially cutaway, view of the principal portion of one embodiment of the apparatus for practicing the method of the present invention.

FIG. 1 is a schematic illustration showing the principle of the method of this invention, and FIG. 2 is a perspective, partially cutaway, view of the principal portion of one embodiment of the apparatus for practicing the method of this invention.

Referring to FIG. 1 showing the principle of the method of this invention, a moving conductor is provided in the form of a heating line or wire L within a magnetic field defined between N and S poles of a permanent magnet 1. The heating line L is shaped in the form of a square or rectangular frame constituting a closed circuit and is caused to rotate about its own axis such that the legs (a) of the heating line L intersecting with the magnetic line of force 2 are perpendicular to the magnetic line of force 2.

With the heating line L being in the form of a closed circuit, it is to be understood that the heating line L has induced current generated therein.

The present invention is also directed to apparatus for heating a fluid flowing through a pipe utilizing the foregoing principle. An embodiment of such apparatus will be described with reference to FIG. 2. The fluid may be either liquid or gas.

The apparatus comprises a permanent magnet 1 having N pole positioned adjacent one side of the outer peripheral surface of the pipe 3 and S pole positioned adjacent the opposite side of the outer peripheral surface in opposing relation to the N pole so as to establish a magnetic field orthogonally crossing the longitudinal axis of the pipe 3.

The end faces of the N and S poles facing the pipe are arcuately shaped so as to be complementary to the shape of the corresponding side wall of the pipe 3. The pipe 3 may be made of material having low permeability.

The apparatus further comprises a central shaft 4 extending through the interior of the pipe 3 centrally thereof and one or more heating lines or wires L at their centers secured to the central shaft 4 between the opposite poles of the permanent magnet 1. The heating lines L are each shaped as a square or rectangular frame constituting a closed circuit and having the legs (a) of the square or rectangular shape orthogonally or transversely intersecting with the magnetic line of force 2.

Secured to the central shaft 4 is an impeller 5 adapted to be rotated by the flow of the fluid (f) flowing through the pipe 3, which in turn causes simultaneous rotation of the rotator-like heating lines L along the inner peripheral surface of the pipe 3 while they move perpendicularly to the the magnetic line of force, with the result that the heating lines L are heated due to induced current generated therein and conduct the heat to the fluid (f) in contact therewith.

From the foregoing description, it can be appreciated that according to the present invention, if water is used as the fluid, simply passing the water through the pipe will provide heated water which is most convenient for use in snow melting, gardening operations and the like.

In another application, the apparatus according to this invention may be utilized in a preheater as a prestage of a boiler whereby a substantial saving of energy may be realized.

Further, if gas is employed as the fluid, this invention may be applicable as a room heater.

In addition, when several units of the apparatus are disposed and interconnected in the pipe, the heating capacity is proportionally enhanced. The longer the distance the water travels, the greater the heating effect.

In addition, the present invention is useful in that owing to the heat energy being in direct contact with the fluid, it provides the advantage that the heat energy required to heat the fluid may be substantially reduced as compared with the conventional practice in which the pipe is heated to indirectly heat the fluid.

I claim:

1. A method for heating a fluid flowing through an interior of a pipe having a wall with an inner and outer peripheral surface, said method comprising the steps of:

locating N and S poles of a magnet adjacent the outer peripheral surface of said pipe on opposite sides, respectively, thereof;

placing heating line means as a conductor in the interior of said pipe between the N and S poles of said magnet and fixing said heating line means to a central shaft extending in the interior of said pipe longitudinally and coaxially with said pipe, said heating line means having portions orthogonally intersecting with a magnetic line of force defined between said N and S poles; and placing an impeller in the interior of said pipe so as to be rotated by the flow of the fluid flowing through the interior of said pipe, and securing the impeller to said central shaft so that those portions of said heating line means orthogonally intersecting with said magnetic line of force around the inner peripheral surface of said pipe are caused to rotate in unison with said central shaft in a direction perpendicular to the magnetic line of force, whereby said heating line means produces a heat due to induced current generated therein to heat the fluid flowing through the interior of said pipe.

* * * * *